US009289060B2

(12) United States Patent
Wu

(10) Patent No.: US 9,289,060 B2
(45) Date of Patent: Mar. 22, 2016

(54) MULTIPLE-LAYER SHELF ASSEMBLY

(71) Applicant: Ping-Hsien Wu, Taichung (TW)

(72) Inventor: Ping-Hsien Wu, Taichung (TW)

( * ) Notice: Subject to any disclaimer, the term of this patent is extended or adjusted under 35 U.S.C. 154(b) by 0 days.

(21) Appl. No.: 14/332,404

(22) Filed: Jul. 16, 2014

(65) Prior Publication Data

US 2016/0015175 A1 Jan. 21, 2016

(51) Int. Cl.

| | |
|---|---|
| ***A47B 43/00*** | (2006.01) |
| ***A47B 47/00*** | (2006.01) |
| ***A47B 57/00*** | (2006.01) |
| ***A47B 57/34*** | (2006.01) |
| ***A47B 96/02*** | (2006.01) |
| ***A47B 96/06*** | (2006.01) |

(52) U.S. Cl.

CPC ..... *A47B 57/34* (2013.01); *A47B 96/02* (2013.01); *A47B 96/06* (2013.01)

(58) Field of Classification Search

CPC ..... A47B 57/265; A47B 57/545; A47F 5/01
USPC ..... 108/147.13; 211/187
See application file for complete search history.

(56) References Cited

U.S. PATENT DOCUMENTS

| | | | | | |
|---|---|---|---|---|---|
| 3,664,274 | A * | 5/1972 | Bustos | 108/147.13 | |
| 4,128,064 | A * | 12/1978 | Chung et al. | 108/192 | |
| 4,593,826 | A * | 6/1986 | Bustos | 211/187 | |
| 4,627,543 | A * | 12/1986 | Nicely | 211/187 | |
| 4,708,309 | A * | 11/1987 | Walter | 248/218.4 | |
| 4,754,712 | A * | 7/1988 | Olson et al. | 108/107 | |
| 4,799,818 | A * | 1/1989 | Sudimak et al. | 403/107 | |
| 4,852,501 | A * | 8/1989 | Olson et al. | 108/107 | |
| 5,127,342 | A * | 7/1992 | Taylor | 108/147.13 | |
| 5,183,167 | A * | 2/1993 | Cheng | 211/187 | |
| 5,884,567 | A * | 3/1999 | Bartz, Jr. | A47B 57/04 108/106 | |
| 5,971,175 | A * | 10/1999 | Bustos | 211/187 | |
| 6,036,033 | A * | 3/2000 | Chang | A47B 57/10 108/107 | |
| 6,079,339 | A * | 6/2000 | Houk et al. | 108/186 | |
| 6,253,933 | B1 * | 7/2001 | Yang | A47B 57/545 108/147.12 | |
| 6,318,572 | B1 * | 11/2001 | Lai | A47B 57/545 108/147.12 | |
| 6,357,611 | B1 * | 3/2002 | Chen | 211/187 | |
| 6,364,139 | B1 * | 4/2002 | Chen | A47B 57/545 108/107 | |
| 7,100,781 | B2 * | 9/2006 | Craft | A47B 57/54 108/147.13 | |
| 8,376,157 | B2 * | 2/2013 | Jarvis et al. | 211/187 | |
| 8,616,138 | B1 * | 12/2013 | Fu | 108/147.13 | |
| 2002/0113180 | A1 * | 8/2002 | Wiebe | 248/188 | |
| 2005/0139562 | A1 * | 6/2005 | Chen | A47B 57/545 211/187 | |
| 2005/0199160 | A1 * | 9/2005 | Ching-Po | 108/107 | |
| 2008/0302748 | A1 * | 12/2008 | Tsai | 211/188 | |
| 2011/0036278 | A1 * | 2/2011 | Karl et al. | 108/147.13 | |
| 2012/0031864 | A1 * | 2/2012 | Wasson et al. | 211/134 | |

* cited by examiner

*Primary Examiner* — Joshua Rodden
*Assistant Examiner* — Kimberley S Wright
(74) *Attorney, Agent, or Firm* — C. G. Mersereau; Nikolai & Mersereau, P.A.

(57) ABSTRACT

A multiple-layer shelf assembly includes a plurality of shelves. At least one support member and multiple engaging members are connected to each other to support the shelves. The at least one support member has at least one ridge and notches are defined in the at least one ridge. Each of the engaging members is a bent tubular member. The at least one support member extends through the engaging members and the engaging members are engaged with the notches of the at least one support member. The shelves are supported on the engaging members.

1 Claim, 11 Drawing Sheets

MULTIPLE-LAYER SHELF ASSEMBLY

BACKGROUND OF THE INVENTION (1) Fields of the Invention

The present invention relates to a multiple-layer shelf assembly, and more particularly, to a multiple-layer shelf assembly using at least one support member and an engaging member which is rotated to be engaged with the notches of the at least one support member so as to support the shelves.

(2) Descriptions of Related Art

The conventional metal and wire shelve assemblies are used widely which provide multiple shelves to manage and organize the objects in a room with limited space. One of the conventional metal and wire shelve assemblies uses bolts to connect the shelves to the posts. However, holes have to be drilled in the posts and each hole is welded with a nut so as to be connected with the bolt. This is complicated and requires a lot of time for the uses to assemble the shelf assembly. The bolts are exposed from the outside of the posts and affect the aesthetic purpose.

Another conventional shelve assembly uses plastic anti-slip members connected to the posts and the four corners of the shelf are mounted to the posts. This conventional shelve assembly does not need any bolt. However, each post has four welding points so that a four-layer shelf assembly has 16 welding points so that there are total of 64 welding points required, and 32 plastic anti-slip members are used so that there are a lot of parts needed which increase the manufacturing cost.

As shown in FIG. 1, the shelf assembly has a shelf 10 which is composed of a netted member 11 and four tubes 12 which are located at the four corners of the netted member 11. A post 13 has a plastic anti-slip member 14 connected thereto, the anti-slip member 14 is a cylindrical and tapered member and composed of two halves. The anti-slip member 14 a rib 141 on the inside thereof and the post has a groove 15 with which the rib 141 is engaged. The tubes 12 are then mounted to the anti-slip members 14 to connect the shelf 10 and the post 13. There are four welding points for the netted member 11 and the four tubes 12. The rib 141 of the anti-slip members 14 have to be precisely connected to the groove 15 of the post 13 by visual measurement, this is not convenient and efficient way to assemble the shelf assembly.

The present invention intends to provide a multiple shelf assembly that eliminates the shortcomings mentioned above.

SUMMARY OF THE INVENTION

The present invention relates to a multiple-layer shelf assembly and comprises a plurality of shelves. At least one support member has at least one ridge and multiple notches are defined in the at least one ridge. Multiple engaging members each are a bent tubular member. The at least one support member extends through the engaging members, and the at least one support member is rotated an angle to engage the engaging members with the notches of the at least one support member. The shelves are supported on the engaging members.

Preferably, each of the engaging members is an individual member and is a rectangular loop. The at least one support member is a rectangular tubular member which has four ridges. When the engaging member is engaged with the notches of the at least one support member, four insertion holes are formed between four sides of the at least one support member and four corners of the engaging member. The shelf has four posts which are respectively inserted into the four insertion holes.

Preferably, the engaging members are integral to the shelf. Each of the engaging members is a rectangular loop and the at least one support member is a rectangular tubular member which has four ridges. The shelf is supported by the at least one support member.

Preferably, the engaging members are integral to the shelf. Each of the engaging members is a rectangular loop. The at least one support member is a cylindrical member which has a ridges extending longitudinally from the outside thereof. The ridge has a triangular cross section and has notches defined therein. The engaging members are engaged with the notches of the ridge of the at least one support member. The shelf is supported by the at least one support member.

The primary object of the present invention is to provide a multiple-layer shelf assembly which is easily assembled without bolts and nuts.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
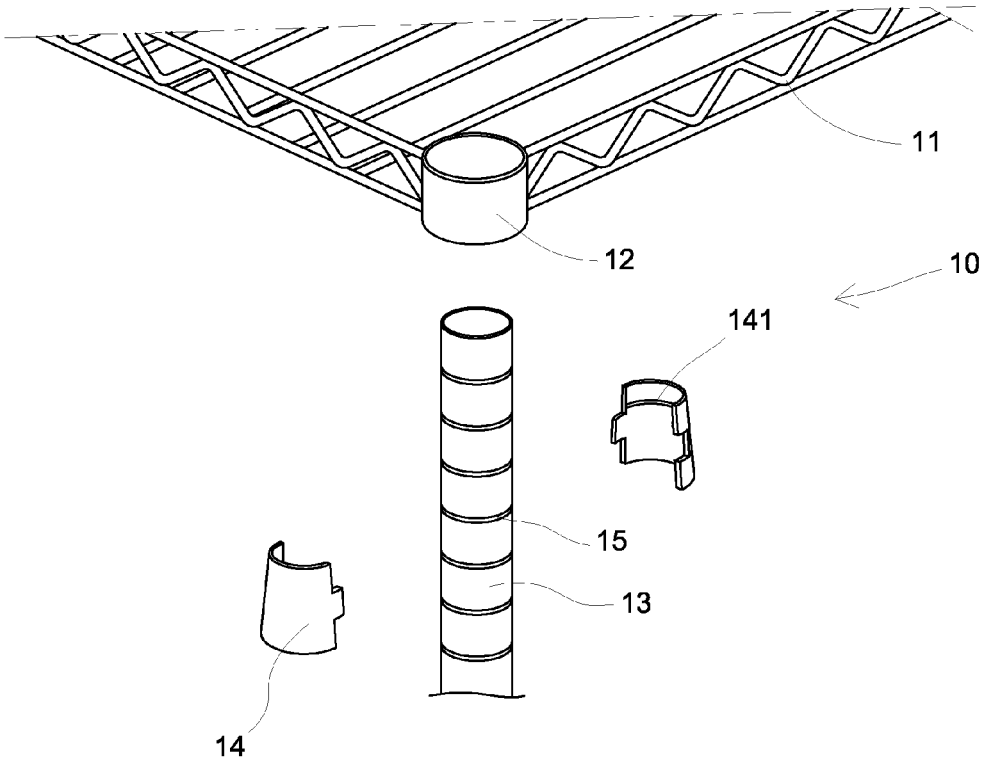
FIG.1 PRIOR ART
FIG. 1 is an exploded view of a conventional shelf assembly.
Figure 2:
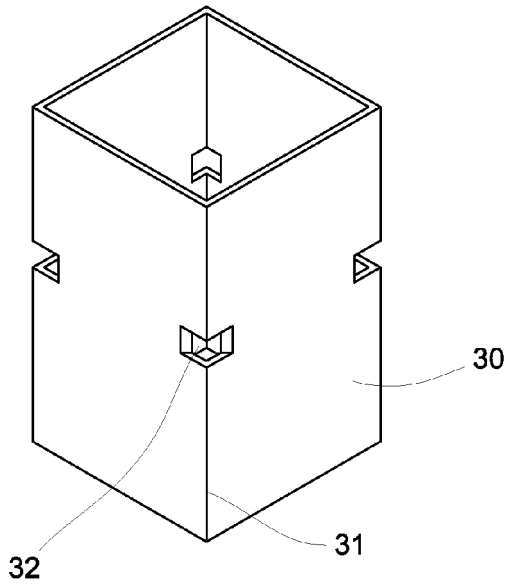
FIG. 2 is a perspective view to show the support member of the present invention.
Figure 3:
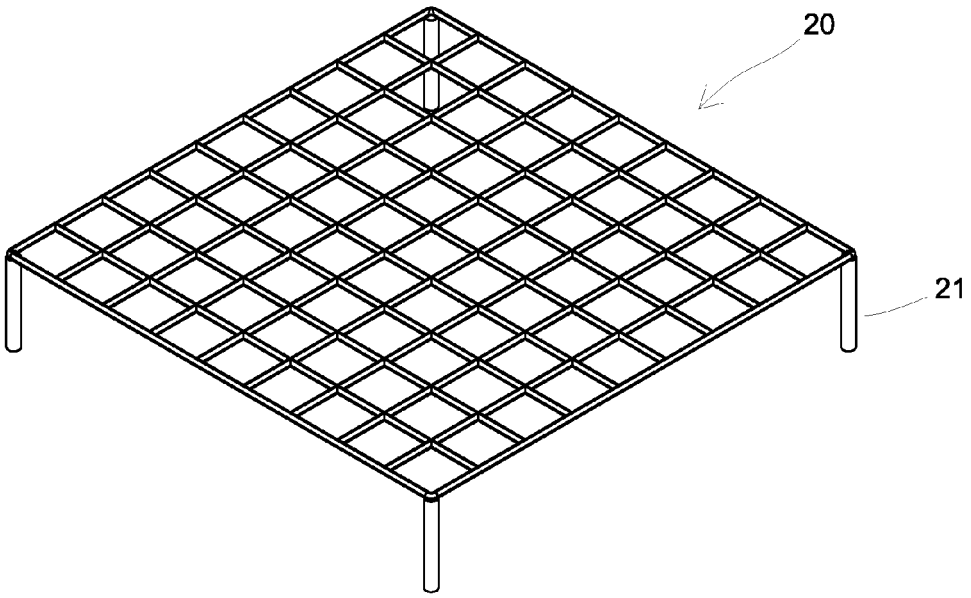
FIG. 3 is a perspective view to show the shelf of the present invention.
Figure 4:
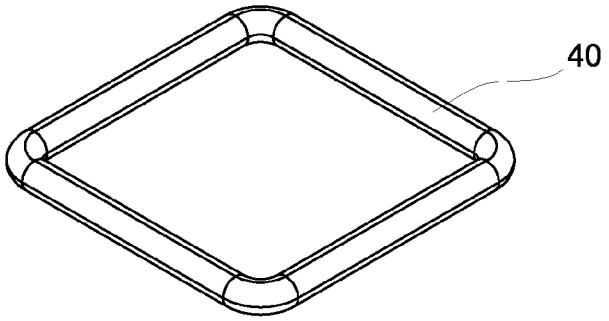
FIG. 4 is a perspective view to show the engaging member of the present invention.

Referring to FIGS. 2 to 4, the layer shelf assembly of the present invention comprises a plurality of shelves 20, at least one support member 30 and multiple engaging members 40. The shelves 20 each comprises multiple longitudinal and latitude wires connected to each other to form a netted shelf, or each of the shelves 20 is a board. The shelves 20 are made by metal, wood, or plastic. Objects are put on the shelves 20 and each of the shelves 20 has posts 21 extending downward. There are multiple support members 30 so as to connect the shelves 20 into multiple layers. Each of the support members 30 can be a rectangular tubular member or irregular shape member. The support members 30 can be hollowed or solid, and have a certain length. FIG. 2 shows a section of one support member 30 and has four ridges 31, multiple notches 32 defined in each of the ridges 31.

Figure 5:
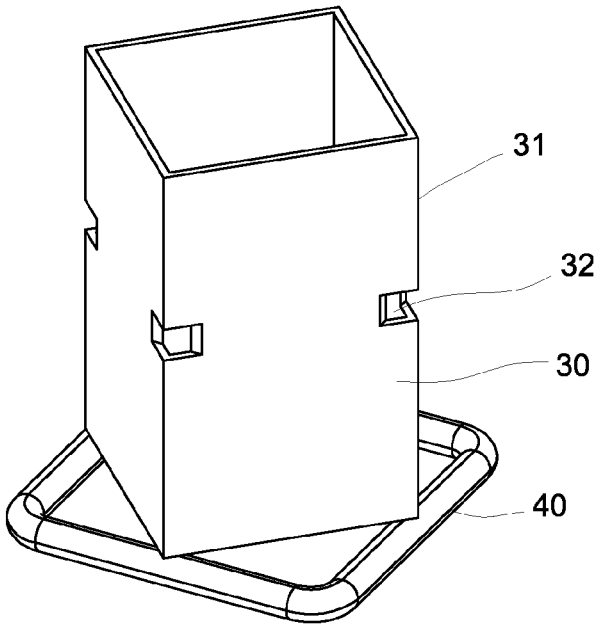
FIG. 5 shows the support member and the engaging member which is positioned at the lower end of the support member of the present invention.
Figure 6:
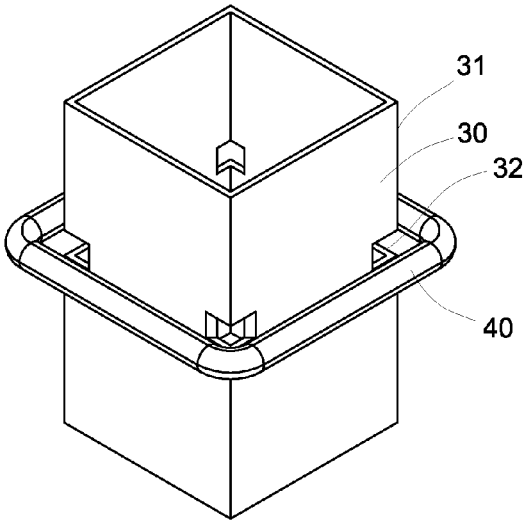
FIG. 6 shows that the support member extends through the engaging member of the present invention.
Figure 7:
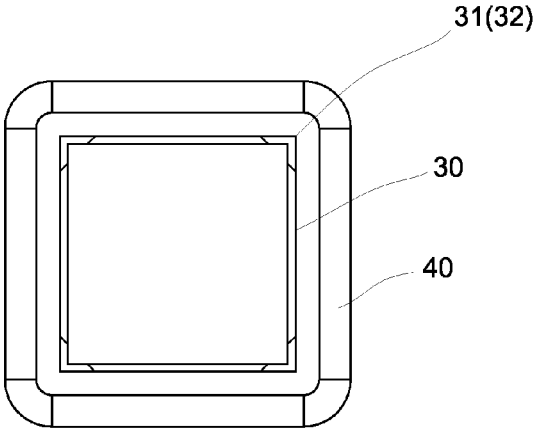
FIG. 7 is a top view to show that the support member extends through the engaging member of the present invention.
Figure 8:
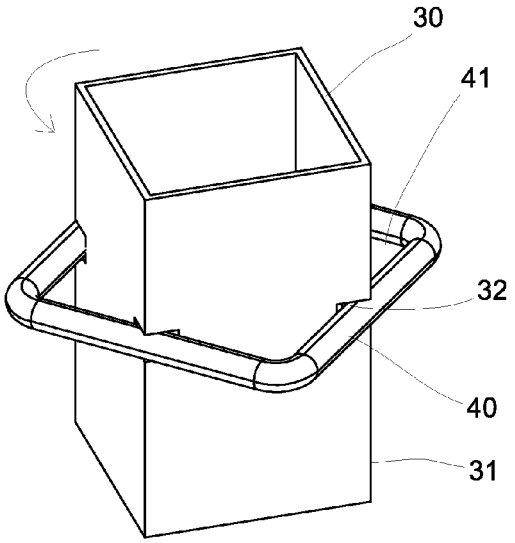
FIG. 8 shows that the support member extends through the engaging member, and the support member is rotated an angle relative to the engaging member of the present invention.
Figure 9:
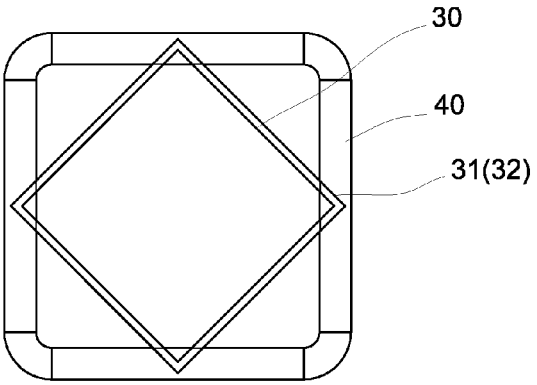
FIG. 9 is a top view to show that the support member extends through the engaging member, and the support member is rotated an angle relative to the engaging member of the present invention.
Figure 10:
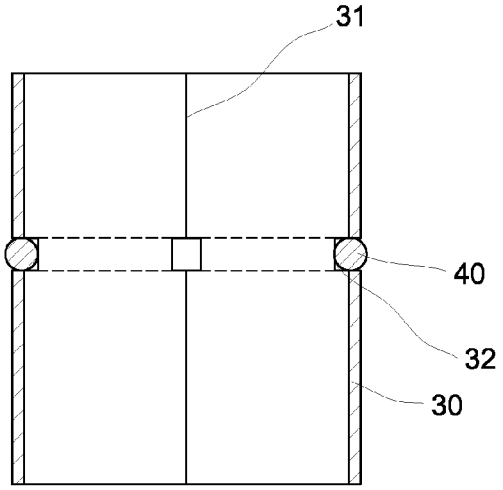
FIG. 10 is a cross sectional view to show that the engaging member is engaged with the notches of the support member of the present invention.
Figure 11:
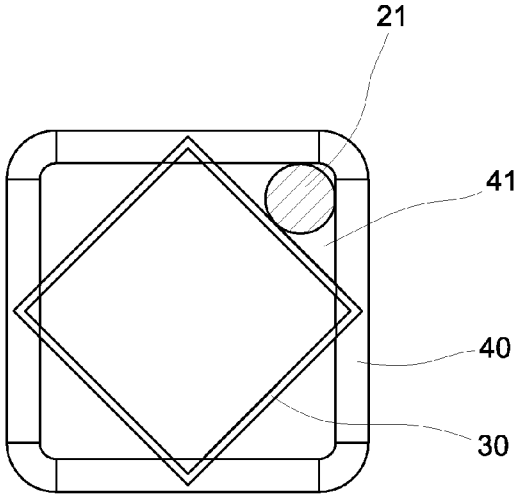
FIG. 11 shows that the post of the shelf is inserted into the insertion hole between the engaging member and the support member of the present invention.

The engaging members 40 each are a bent tubular member which is a rectangular loop so that the support member 30 can extend through the engaging members 40 as shown in FIGS. 5 to 7. When the support member 30 extends through the engaging members 40, the four sides of each engaging member 40 are parallel to the four sides of the support member 30. When the support member 30 is rotated an angle, the engaging members 40 are engaged with the notches 32 of the support member 30. Four insertion holes 41 are formed between the four sides of the support member 30 and the four corners of the engaging members 40 as shown in FIGS. 8 and 11. The four posts 21 of the shelf 20 are respectively inserted into the four insertion holes 41.

As shown in FIGS. 7 to 11, the support member 30 extends through the engaging members 40, and the support member 30 is rotated an angle, the engaging members 40 are engaged with the notches 32 of the support member 30. The four posts 21 of the shelf 20 are respectively inserted into the four insertion holes 41 so that the shelf 20 is supported on the engaging member 40. Each support member 30 is connected with multiple engaging members 40 along the axial direction of the support member 30 so that multiple shelves 20 are supported to the engaging members 40 to form multiple layers of the shelf assembly. In this embodiment, there are four support members 30 to be connected with multiple engaging member 40. The number of the support members 30 can also be three and the number of the posts 21 can be two to form different shapes of the shelf assembly.

Figure 12:
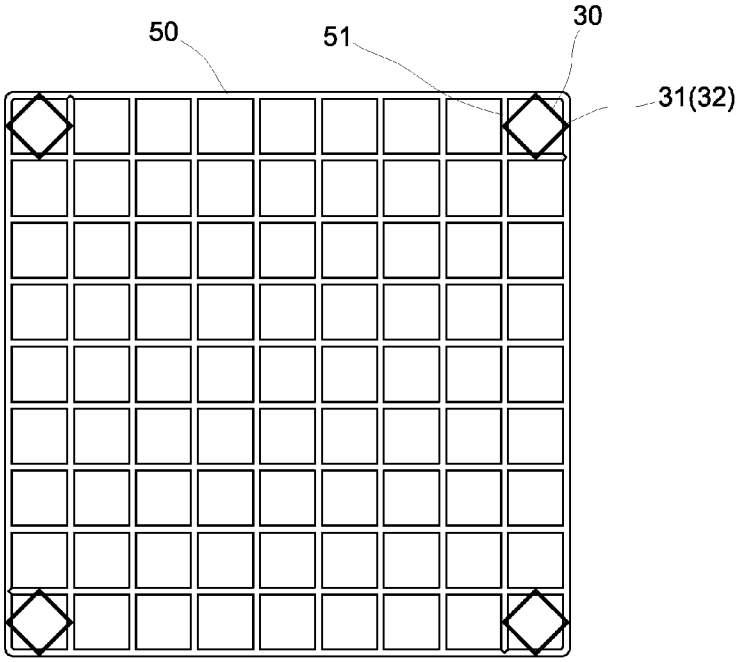
FIG. 12 is a plan view to show the second embodiment of the shelf assembly of the present invention.

FIGS. 2 and 12 show the second embodiment, wherein the engaging members 51 are integral to the shelf 50 which is a netted shelf. The engaging members 51 are located at the four corners of the shelf 50. The shelf 50 is supported on the engaging members 51. The support members 30 each are a rectangular tubular member which has four ridges 31, and each ridge 31 has notches 32.

The support members 30 are inserted through the engaging members 51 of the shelf 50, and the support members 30 are rotated an angle until the engaging members 51 are engaged with the notches 32 of the support members 30. The shelf 50 is supported by the support members 30 and the engaging members 51. In this embodiment, there are four support members 30 to support the shelf 50. The number of the support members 30 can also be three. If the shelf 50 is a board, the engaging member 51 is located at the center of the shelf 50, one support member 30 extends through the engaging member 51, and the shelf 50 is support by the support member 30.

Figure 13:
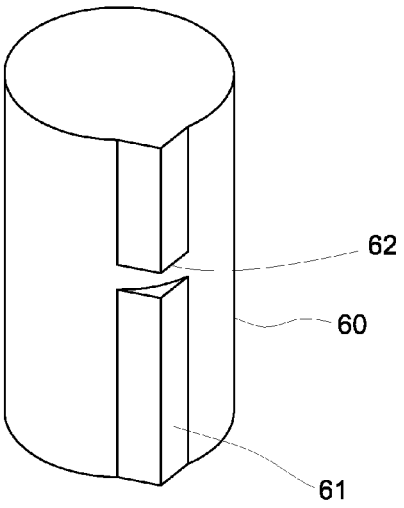
FIG. 13 is a perspective view to show the third embodiment of the support member of the present invention.
Figure 14:
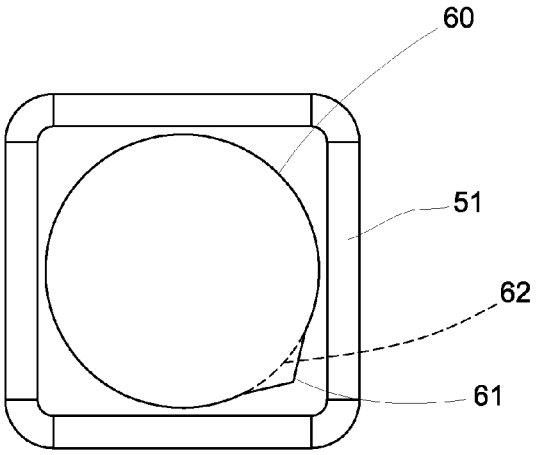
FIG. 14 is a plan view to show that the support member of the third embodiment extends through the engaging member of the present invention.
Figure 15:
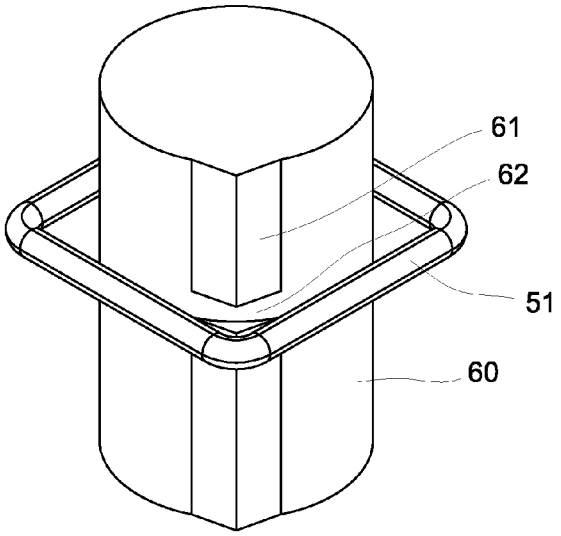
FIG. 15 is a perspective view to show that the support member of the third embodiment extends through the engaging member of the present invention.
Figure 16:
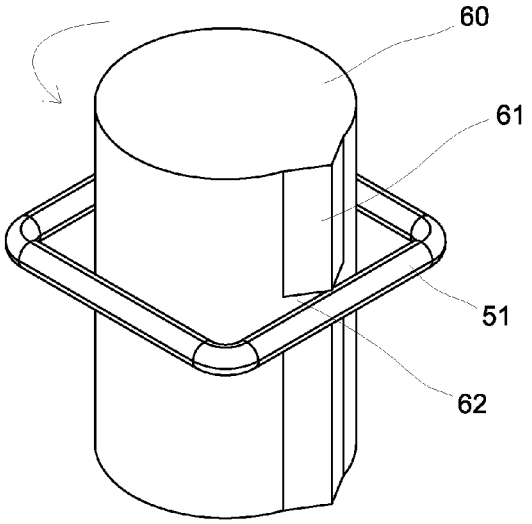
FIG. 16 is a perspective view to show that the support member of the third embodiment extends through the engaging member, and the support member is rotated an angle relative to the engaging member of the present invention.
Figure 17:
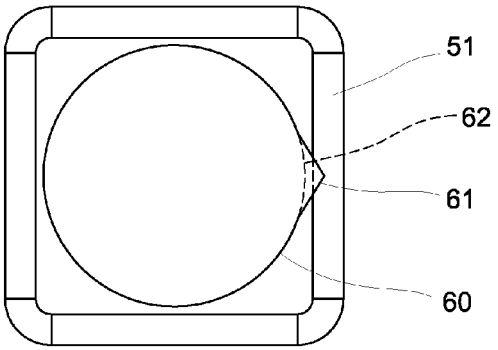
FIG. 17 is a plan view to show that the support member of the third embodiment extends through the engaging member, and the support member is rotated an angle relative to the engaging member of the present invention.
Figure 18:
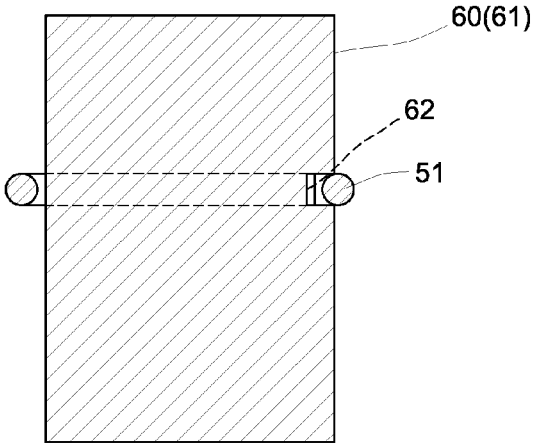
FIG. 18 is a cross sectional view to show that the engaging member of the third embodiment is engaged with the notches of the support member of the present invention.
Figure 19:
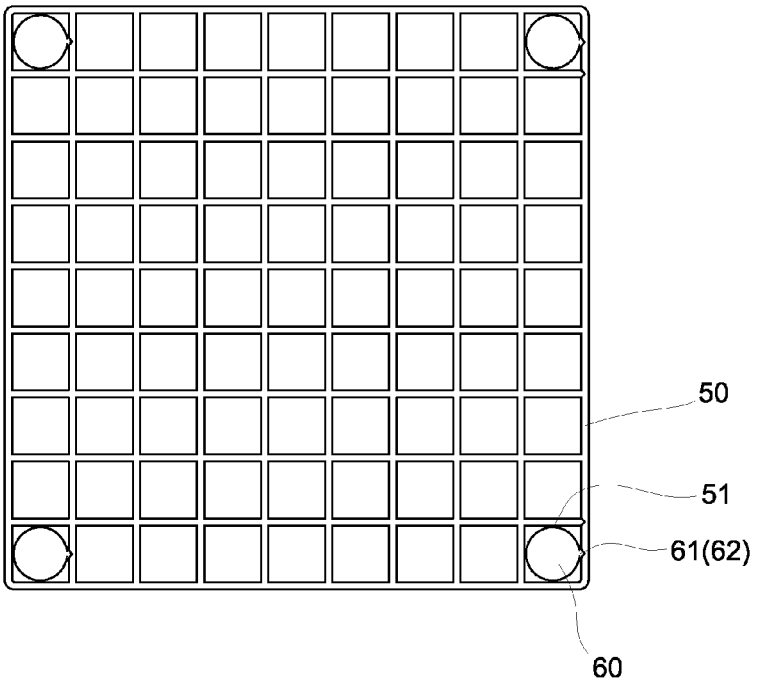
FIG. 19 is a plan view to show that the support members extend through the shelf and are rotated an angle relative to the shelf.
Figure 20:
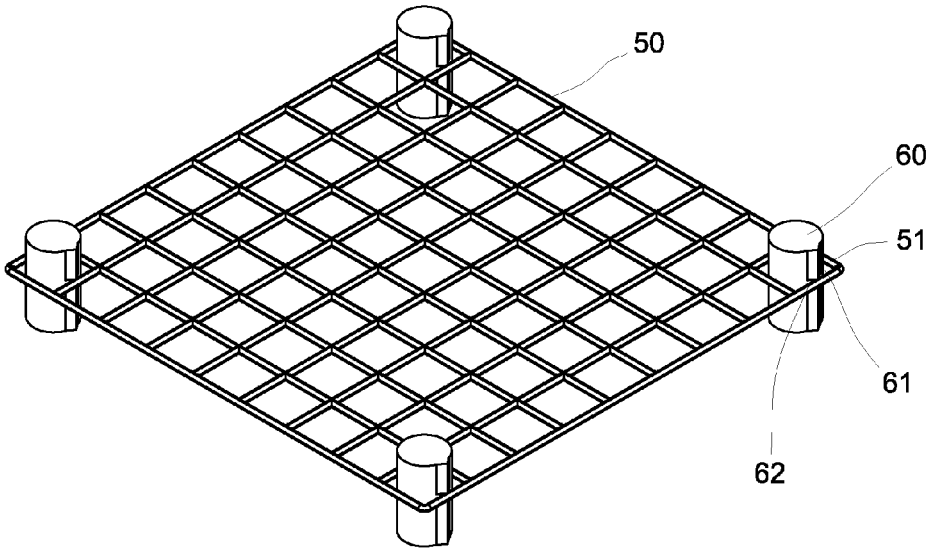
FIG. 20 is a perspective view to show that the support members extend through the shelf and are rotated an angle relative to the shelf.

FIGS. 13 to 19 show the third embodiment, wherein the engaging members 51 are the same as those in the second embodiment, the engaging members 51 are integral to the shelf 50. Each of the engaging members 51 is a rectangular loop. The support members 60 each are a cylindrical member and a section of the support member 60 is shown in FIG. 13. A ridges 61 extends longitudinally from the outside of each of the support members 60. The ridge 61 has a triangular cross section and has notches 62 defined therein. The engaging members 51 are engaged with the notches 62 of the ridge 61 of the support member 60. The shelf 50 is supported by the support members 60 as shown in FIGS. 17 to 20.

While we have shown and described the embodiment in accordance with the present invention, it should be clear to those skilled in the art that further embodiments may be made without departing from the scope of the present invention.

What is claimed is:

1. A multiple-layer shelf assembly comprising:

a plurality of shelves;

at least one support member having a length and at least one ridge, multiple notches defined in the at least one ridge, the at least one support member located at the shelves to support the shelves to be multiple layers, multiple engaging members each being a bent tubular member and connected to the shelves, the at least one support member extending through the engaging members, the at least one support member being rotated an angle to engage the engaging members with the notches of the at least one support member, the shelves being supported on the engaging members, and wherein each of the engaging members is a rectangular loop, the at least one support member is a cylindrical member, the at least one ridge extending longitudinally from an outside thereof, the at least one ridge having a triangular cross section and the notches defined therein, each of the engaging members is engaged with the notches of the at least one ridge of the at least one support member, each shelf is supported by the at least one support member.

* * * * *